US008859460B2

(12) United States Patent
Behrens et al.

(10) Patent No.: US 8,859,460 B2
(45) Date of Patent: Oct. 14, 2014

(54) HEAT-SENSITIVE RECORDING MATERIAL HAVING AUTHENTICITY FEATURE

(75) Inventors: Ulf Behrens, Harrislee (DE); Gerhard Stork, Flensburg (DE); Svenja Eisernitz, Flensburg (DE); Matthias Marx, Nortorf (DE)

(73) Assignee: Mitsubishi HiTec Paper Europe GmbH, Flensburg (DE)

( * ) Notice: Subject to any disclaimer, the term of this patent is extended or adjusted under 35 U.S.C. 154(b) by 0 days.

(21) Appl. No.: 13/512,985

(22) PCT Filed: Nov. 30, 2010

(86) PCT No.: PCT/EP2010/068494

§ 371 (c)(1),
(2), (4) Date: Jan. 2, 2013

(87) PCT Pub. No.: WO2011/067239

PCT Pub. Date: Jun. 9, 2011

(65) Prior Publication Data

US 2013/0123101 A1 May 16, 2013

(30) Foreign Application Priority Data

Dec. 1, 2009 (EP) ..... 09177679

(51) Int. Cl.

| | |
|---|---|
| ***B41M 3/14*** | (2006.01) |
| ***B41M 5/327*** | (2006.01) |
| ***B41M 5/333*** | (2006.01) |
| ***B41M 5/337*** | (2006.01) |
| ***B41M 5/42*** | (2006.01) |
| ***B41M 5/44*** | (2006.01) |

(52) U.S. Cl.

CPC . *B41M 3/14* (2013.01); *B41M 5/42* (2013.01); *B41M 5/3372* (2013.01); *B41M 5/3275* (2013.01); *B41M 5/44* (2013.01); *B41M 5/3336* (2013.01)

USPC ..... 503/226; 503/209; 503/214; 503/216; 503/217; 503/219; 503/221

(58) Field of Classification Search

CPC ..... B41M 3/10; B41M 3/14; B41M 5/3336; B41M 5/3372; B41M 5/44; B41M 5/327

USPC ..... 503/200–226; 283/94–96

See application file for complete search history.

(56) References Cited

U.S. PATENT DOCUMENTS

| | | | | |
|---|---|---|---|---|
| 5,275,870 | A | 1/1994 | Halope et al. | |
| 5,919,729 | A * | 7/1999 | Mori et al. | 503/200 |
| 6,632,773 | B1 * | 10/2003 | Kranz et al. | 503/201 |
| 7,546,946 | B2 * | 6/2009 | Hefner et al. | 235/380 |

FOREIGN PATENT DOCUMENTS

| | | | |
|---|---|---|---|
| EP | 0 844 097 | A | 5/1998 |
| WO | WO 02/079883 | A1 | 12/2002 |

* cited by examiner

*Primary Examiner* — Bruce H Hess
(74) *Attorney, Agent, or Firm* — Cozen O'Connor

(57) ABSTRACT

A heat-sensitive recording material includes at least a paper substrate, a heat-sensitive recording layer arranged on the front side of the substrate and which has at least one dye precursor and at least one color acceptor, wherein dye precursor and color acceptor react with one another under the action of heat to form color, and an authenticating security feature. The authenticating security feature is a mark which is applied to the back side of the paper substrate and which is made of a tincture having at least one organic solvent. A barrier coating is arranged between the substrate and heat-sensitive recording layer and is suitable to protect the heat-sensitive recording layer against penetration of the tincture into the heat-sensitive recording layer from the back side.

20 Claims, No Drawings

HEAT-SENSITIVE RECORDING MATERIAL HAVING AUTHENTICITY FEATURE

PRIORITY CLAIM

This is a U.S. national stage of application No. PCT/EP2010/068494, filed on Nov. 30, 2010. Priority is claimed on the following application: Country: EP, Application No.: 09177679.9, Filed: Dec. 1, 2009, the content of which is incorporated herein in its entirety by reference.

FIELD OF THE INVENTION

The invention is directed to a heat-sensitive recording material comprising a paper substrate having on the front side thereof at least one heat-sensitive recording layer which in turn has at least one dye precursor or color former and at least one color acceptor which react with one another under the action of heat to form color. The proposed heat-sensitive recording material has an authenticating security feature by means of which the genuineness of a respective recording material can be proved.

BACKGROUND OF THE INVENTION

Recording materials determine the daily routine of businesses and professional life. Various solutions for authenticating security features have already been suggested in the past for use with recording materials whose authorized use must generally be verified by a specific mark on the material permitted for this purpose.

Proof of authenticity for documents in the form of passive inspection is made possible, for example, through watermarks. By watermark is meant, generally, a mark in the paper which is generated through different paper thicknesses. A distinction is made between true watermarks which are produced by displacement (so-called light watermarks) or by concentration (so-called shaded watermark) of the fiber pulp using, for example, a dandy roll in the wire section of a paper machine, impressed watermarks, also called Molette watermarks, which are produced by impressing the paper while still wet in the press section of a paper machine, and, finally, imitation watermarks which are made either by imprinting the finished paper outside the paper machine with a colorless varnish or by stamping the finished paper outside the paper machine.

Suggestions for imitation watermarks are found in EP 0 203 499 B1, which provides a paper web which, through the addition of suitable substances, is deformable by means of heat and possibly also under the simultaneous application of pressure, and in DE 39 20 378 A1 which discloses the arrangement of a watermark outside the paper machine by imprinting with a varnish. The disadvantages of these suggestions consist in that illegal copying of a watermark of this kind is rather easy.

According to a suggestion in DE 690 01 677 T2, a synthetic print medium with pseudo-watermarks is provided. This known print medium comprises a substrate of plastic, at least one authentication mark or security mark which is preferably applied by intaglio printing and which changes the opacity of the print medium, and at least one printable pigment coating covering the mark. The monochromatic or polychromatic mark is barely visible in reflected light but can easily be seen under transmitted light. This known print medium also has the basic drawback that the imprinted pseudo-watermark can be forged relatively easily, which can also not be prevented by simple pigment coatings applied thereto.

Heat-sensitive recording materials with authenticating security features in the form of watermarks are also generally known. For example, EP 0 844 097 A1 discloses, as a first security feature for a heat-sensitive recording material in the form of an imitation watermark, a latent image which is printed on the back side of the recording material and is produced by a security ink containing a fluorescent reagent. The security ink contains a water-repelling agent to form a second security feature in the form of a waterproof image on the back side of the heat-sensitive recording material. The security ink containing the fluorescent reagent, which is used as pigment or dye, and the water-repelling agent is contained or dispersed in an aqueous carrier which, in addition to these components, can also contain a binder.

As is generally the case in all of the suggestions relying on the use of imitation watermarks, the disadvantage in this suggestion consists in that counterfeiting or copying can be accomplished fairly easily. Even if the desired security features, or those to be formed, are carried out in the midst of the production process, additional problems arise with respect to high investment costs and sometimes also poor flexibility.

SUMMARY OF THE INVENTION

Based on the set of problems described above, the invention has the object of developing a heat-sensitive recording material having an authenticating security feature, which heat-sensitive recording material

- can be produced economically,
- makes possible a reliable proof of authenticity,
- is flexible with respect to use, and
- has a recording layer which can form a print image brought about under the action of heat.

In order to meet this object, a heat-sensitive recording material is suggested which has at least a paper substrate, a heat-sensitive recording layer which is arranged on the front side of the substrate and has at least one dye precursor or color former and at least one color acceptor, wherein dye precursor and color acceptor react with one another under the action of heat to form color, and an authenticating security feature, characterized in that the authenticating security feature is a mark which is applied to the back side of the paper substrate and which is made of a tincture having at least one organic solvent, and in that a barrier coating is arranged between paper substrate and heat-sensitive recording layer and is suitable to protect the heat-sensitive recording layer against penetration of the tincture into the heat-sensitive recording layer from the back side.

The application of the tincture having the at least one organic solvent to the substrate made of paper for forming the authentication feature causes a change in the opacity or in the transparency of the paper substrate at the locations wetted with the tincture compared to the locations on the substrate not wetted with the tincture. When the heat-sensitive recording material which is proposed herein and treated in this way is held against a light source, the change in transparency when looking through it appears in a sharp-edged manner as an easily discernible image or pattern. It is also possible that the tincture comprises a mixture of a plurality of organic solvents. In another claimed embodiment, other constituents such as, e.g., fluorescent fibers and/or pigments are contained in the tincture in addition to the at least one organic solvent.

Analog printing methods, for example, such as flexographic and intaglio printing methods are suitable for applying the tincture forming the authentication feature. In a preferred embodiment, the tincture is applied by digital printing methods. When the tincture is applied by digital printing technology, the inkjet printing method, among others, is a particularly effective option and is also particularly preferable because it allows an individual authentication feature to be formed for each individual sheet or individual portion of the heat-sensitive recording material proposed herein. When the heat-sensitive recording material proposed herein is used as a ticket and/or in particular as an admission ticket, each individual admission ticket can be provided with an individual authentication feature. In case of an admission ticket for a soccer match, for example, the promoter, venue, game time, opposing soccer teams, place and time of purchase of the ticket, and perhaps also a consecutive control number as individual authentication feature can be formed on the heat-sensitive recording material proposed herein. Counterfeiting of an authentication feature of this kind is difficult and, given a corresponding check at the event location, is futile. By proposing as solution to the problem a heat-sensitive recording material whose authenticating security feature consists in a mark which is applied to the back of the substrate and which is made from a tincture with at least one organic solvent and is formed individually for each individual portion, a ticket material is made available to the public which, as admission ticket, can no longer be successfully counterfeited in practice: an attempted counterfeit can be proven immediately by means of the particularly simple identification of the individual security feature.

Due to the fact that the organic solvent in the tincture can cause either an unwanted color-forming reaction in the recording layer or—depending on other components in the tincture—a fading or extinguishing of a character image which is to be formed, or which is formed, in the recording layer, it is essential to the invention that the tincture applied to the back side of the paper substrate is reliably and permanently kept at a distance from the heat-sensitive recording layer. This is the purpose of the barrier coating. To this end, the barrier coating preferably chiefly comprises binders selected from the list comprising:

- fully saponified or partially saponified polyvinyl alcohols, preferably cross-linked by borax or boric acid,
- carboxyl group-modified or silanol-modified polyvinyl alcohols,
- film-forming acrylic copolymers, wherein the above-mentioned binders can be used individually or in combination with one another.

DETAILED DESCRIPTION OF THE PRESENTLY PREFERRED EMBODIMENTS

In a first particularly preferred alternative embodiment according to this paragraph and the below paragraphs in which very good test results were achieved, the barrier coating has as binder at least 60 percent by weight, particularly preferably at least 85 percent by weight, of diacetone-modified polyvinyl alcohol based on the total binder component in the barrier coating.

In addition to the diacetone-modified polyvinyl alcohol, the barrier coating can have other binders, particularly mixtures of different fully saponified or partially saponified polyvinyl alcohols, carboxyl group-modified or silanol-modified polyvinyl alcohols, and film-forming acrylic copolymers. In this case, they constitute a maximum 40 percent by weight, particularly preferably only a maximum of 15 percent by weight, again based on the total binder component in the barrier coating. In a second possible embodiment within this first alternative embodiment, the barrier coating of the heat-sensitive recording material according to the invention has exclusively diacetone-modified polyvinyl alcohol as binder.

Suitable cross-linking agents in the barrier coating according to the first alternative embodiment are particularly those selected from the following group: boric acid, polyamine, epoxy resin, dialdehyde, formaldehyde oligomers, epichlorohydrin resin, adipic acid dihydrazide, dimethyl urea, and melamine formaldehyde. Mixtures of different cross-linking agents are also possible.

The ratio of weight percent of binder, particularly diacetone-modified polyvinyl alcohol, to cross-linking agent in the barrier coating preferably ranges from 20:1 to 5:1 and is particularly preferably in the range of 12:1 to 7:1.

In a second particularly preferred alternative embodiment according to this paragraph and the following paragraph by which very good test results were likewise achieved, the barrier coating contains ethylene vinyl alcohol copolymer (EVOH). In tests, it was shown that even a long exposure to the tincture having larger amounts of the at least one organic solvent which was applied to the back side of the paper substrate was not able to penetrate the barrier coating containing ethylene vinyl alcohol copolymer (EVOH). Accordingly, the heat-sensitive recording layer is reliably kept away from the tincture containing the at least one solvent by the barrier coating containing ethylene vinyl alcohol copolymer (EVOH).

In this regard, the barrier coating preferably comprises at least 90 percent by weight, particularly preferably at least 98 percent by weight, of ethylene vinyl alcohol copolymer based on the total weight of the barrier coating. Additional constituents of this barrier coating are, for example, defoaming agents and/or means for stabilizing the ink curtain in the eventuality that the coating composition for the barrier coating is applied by means of curtain coaters or slide coaters.

Regardless of the embodiment or alternative embodiment, the coating weight for the barrier coating is preferably in a range of 0.9 to 5.0 g/m$^2$, particularly preferably in a range of 1.5 to 3.5 g/m$^2$. Coating equipment which is considered particularly suitable for applying this barrier coating are particularly noncontacting coaters such as air brushes, curtain coaters and slide coaters without limiting in any way to the latter.

The composition of the heat-sensitive recording layer is less limited. In this respect, the inventors recognized with regard to the stated object that the recording layer can, first, as a matter of principle, contain all known dye precursors or color formers, combinations of more than one dye precursor also being possible.

As dye precursors in the heat-sensitive recording layer, the heat-sensitive recording material preferably has at least one substance selected from the list comprising: 3-diethylamino-6-methyl-7-anilinofluoran, 3-dibutylamino-6-methyl-7-anilinofluoran, 3-(N-methyl-N-propyl)amino-6-methyl-7-anilinofluoran, 3-(N-ethyl-N-isoamyl)amino-6-methyl-7-anilinofluoran, 3-(N-methyl-N-cyclohexyl)amino-6-methyl-7-anilinofluoran, 3-(N-ethyl-N-tolyl)amino-6-methyl-7-anilinofluoran, and 3-(N-ethyl-N-tetrahydrofuryl)amino-6-methyl-7-anilinofluoran. In this respect, 3-dibutylamino-6-methyl-7-anilinofluoran—also known as ODB-2—is particularly preferable.

However, in addition to these substances specified as dye precursors, the recording material according to the invention can also contain one or more of the following compounds which are absorbent in the near infrared range:

3,6-Bis(dimethylamino)fluorene-9-spiro-3'-(6'-dimethylaminophthalide), 3-diethylamino-6-dimethylaminofluorene-9-spiro-3'-(6'-dimethylaminophthalide), 3,6-bis(diethylamino)fluorene-9-spiro-3'-(6'-dimethylaminophthalide), 3-dibutylamino-6-dimethylaminofluorene-9-spiro-3'-(6'-dimethylaminophthalide), 3-dibutylamino-6-diethylaminofluorene-9-spiro-3'-(6'-dimethylaminophthalide), 3,6-bis(dimethylamino)fluorene-9-spiro-3'-(6'-diethylamino phthalide), 3-diethylamino-6-dimethylaminofluorene-9-spiro-3'-(6'-diethylaminophthalide), 3-dibutylamino-6-dimethylaminofluorene-9-spiro-3'-(6'-diethylaminophthalide), 3,6-bis-(diethylamino)fluorene-9-spiro-3'-(6'-diethylaminophthalide), 3,6-bis-(dimethylamino)fluorene-9-spiro-3'-(6'-dibutylaminophthalide), 3-dibutylamino-6-di-ethylaminofluorene-9-spiro-3'-(6'-diethylaminophthalide), 3-diethylamino-6-dimethylaminofluorene-9-spiro-3'-(6'-dibutylaminophthalide), 3,3-bis[2-(4-dimethylaminophenyl)-2-(4-methoxyphenyl)ethenyl]-4,5,6,7-tetrachlorophthalide.

In general, particularly at least one of the substances is selected from the following list as possible color acceptor:

2,2-bis(4-hydroxyphenyl)propan,

4-[(4-(1-methylethoxy)phenyl)sulfonyl]phenol, 4,4'-dihydroxydiphenyl sulfone,

N-(p-toluenesulphonyl)-N'-3-(p-toluenesulphonyloxyphenyl)urea, 2,4'-dihydroxydiphenyl sulfone, N-(2-hydroxyphenyl)-2-[(4-hydroxyphenyl)thio]acetamide, without in any way being limited to the color acceptors mentioned above.

In a first preferred embodiment according to this paragraph and the below paragraphs, the heat-sensitive recording layer has as color acceptor at least 33¼ percent by weight, based on the total color acceptor component in the heat-sensitive recording layer, of N-(p-toluenesulphonyl)-N'-3-(p-toluenesulphonyloxyphenyl)urea according to the following formula (1), where the two $CH_3$ end molecules are often omitted in the literature:

Formula (1)

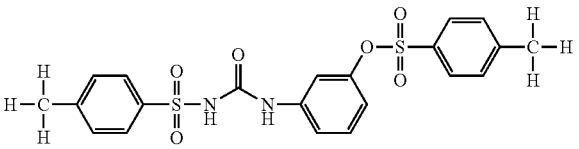

N-(p-toluenesulphonyl)-N'-3-(p-toluenesulphonyloxyphenyl)urea, according to Formula (1) above, is known as Pergafast® 201 by CIBA Speciality Chemicals Inc.

In this first embodiment, it is particularly preferable that N-(p-toluenesulphonyl)-N'-3-(p-toluenesulphonyloxyphenyl)urea according to Formula (1) is the sole color acceptor. Based on the total weight of the recording layer, the color acceptor then constitutes up to 32 percent by weight, but preferably a proportion in a range from 18 to 30 percent by weight, better yet between 20 and 28.5 percent by weight, of the heat-sensitive recording layer.

The recording layer of the heat-sensitive recording material according to the invention in this first embodiment can also preferably contain sensitizers in order to increase thermal responsiveness. Sensitizers of this kind are, first, the substances mentioned in the paragraph below; but 2-(2H-benzotriazol-2-yl)-p-cresol according to the following formula (2) is particularly preferred in this first embodiment, where the two $CH_3$ end molecules are often omitted in the literature in this case also:

Formula (2)

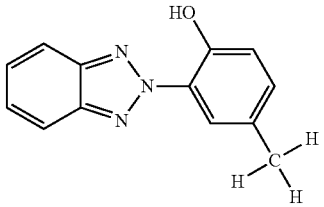

2-(2H-benzotriazol-2-yl)-p-cresol according to Formula (2), available as Tinuvin® from CIBA Speciality Chemicals Inc., can be used as the sole sensitizer or in combination with the sensitizers mentioned in the paragraph below in the recording layer of the recording material according to the invention.

In a second embodiment, likewise preferred, according to this paragraph and the following paragraphs, the heat-sensitive recording layer has, as color acceptor, at least 66% percent by weight of 4,4'-dihydroxydiphenyl sulfone based on the total color acceptor component in the heat-sensitive recording layer.

4,4'-Dihydroxydiphenyl sulfone is also commonly called 4,4'-sulfonyldiphenol and is also known under the trade name 4,4 Bisphenol S. The empirical chemical formula of 4,4'-dihydroxydiphenyl sulfone is $C_{12}H_{10}O_4S$, which can be represented by the following formula (3):

Formula (3):

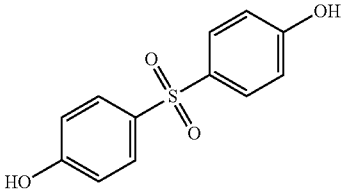

In addition to 4,4'-dihydroxydiphenyl sulfone, the heat-sensitive recording layer of the heat-sensitive recording material according to the invention can have additional color acceptors selected from the list comprising:

2,2-bis(4-hydroxyphenyl)propan—also known as bisphenol A,

4-[(4-(1-methylethoxy)phenyl)sulfonyl]phenol—also known as D8, and

Pergafast® 201.

Preferably, a maximum of 10 percent by weight of the aforementioned color acceptors—based on the total color acceptor component in the heat-sensitive recording layer—are incorporated individually or in combination in this heat-sensitive recording layer, with 4,4'-dihydroxydiphenyl sulfone accounting for the remainder. Finally, in a particularly preferred embodiment, 4,4'-dihydroxydiphenyl sulfone is the only color acceptor in the heat-sensitive recording layer.

To increase thermal responsiveness, the recording layer of the heat-sensitive recording material according to the invention can preferably also contain sensitizers, ideally with a melting point of 60° C. to 180° C., particularly preferably with a melting point of 80° C. to 140° C. Examples of sensitizers of this type are: benzyl-p-benzyloxybenzoate, methylolstearamide, stearic acid amide, p-benzylbiphenyl, 1,2-di(phenoxy)ethane, 1,2-di(m-methylphenoxy)ethane, m-terphenyl, dibenzyloxalate, benzyl naphthyl ether, dimethyl terephtalate, and diphenyl sulfone, most preferably methylolstearamide and, in particular, stearic acid amide and dimethyl terephtalate.

It has been shown in numerous tests for the second preferred embodiment relating to the heat-sensitive recording layer that a ratio of color acceptor$_{total}$:sensitizer$_{total}$ and particularly 4,4'-dihydroxydiphenyl sulfone: sensitizer selected from the list comprising methylolstearamide, stearic acid amide, and dimethyl terephtalate based on weight percent in the recording layer is preferably in a range of 1:0.5 to 1:2 and particularly preferably in a range of 1:0.8 to 1:1.4

Suitable binders for incorporating in the heat-sensitive recording layer are, for example, water-soluble binders such as starch, hydroxy ethyl cellulose, methyl cellulose, carboxy methyl cellulose, gelatins, casein, polyvinyl alcohols, modified polyvinyl alcohols, ethylene vinyl alcohol copolymers, sodium polyacrylates, acrylamide/acrylate copolymers, acrylamide/acrylate/methacrylate terpolymers, and alkali salts of styrene maleic acid anhydride copolymers or ethylene maleic acid anhydride copolymers, wherein the binders can be used alone or in combination with one another; also, water-insoluble latex binders such as styrene-butadiene copolymers, acryl nitrile butadiene copolymers, and methyl acrylate butadiene copolymers can be used as binders for incorporation in the heat-sensitive recording layer. Within the meaning of the present invention, polyvinyl alcohol, ethylene vinyl alcohol copolymers, or polyvinyl alcohol in combination with ethylene vinyl alcohol copolymers are particularly preferred binders which are incorporated together in the heat-sensitive recording layer in a range of 10 to 20 percent by weight based on the total weight of the recording layer.

To prevent sticking to a thermal head and to prevent excessive wear of the thermal head, the coating composition for forming the heat-sensitive recording layer—in general and within the first and second preferred embodiments relating to the heat-sensitive recording layer—can also contain lubricants and release agents such as metal salts of higher fatty acids, for example, zinc stearate, calcium stearate, and waxes such as, e.g., paraffin, oxidized paraffin, polyethylene, polyethylene oxide, stearic acid amide, and castor wax. Other possible constituents of the recording layer are, for example, pigments, preferably inorganic pigments such as, for example, aluminum (hydr)oxide, silicic acid, and calcium carbonate. Calcium carbonate which is preferably incorporated in the recording layer in a quantity of from 0 to 28 percent by weight based on the total weight of the recording layer is preferred.

Generally and within the first and second preferred embodiments relating to the heat-sensitive recording layer, roll doctor coating units, knife coating units, curtain coaters, or air brushes are particularly suitable as coating devices for applying the heat-sensitive recording layer. According to a preferred embodiment, the coating composition used to form the recording layer is aqueous. The subsequent drying of the coating composition is usually carried out by a process in which heat is supplied such as by hot air floatation dryers or contact dryers. A combination of the aforementioned drying methods has also proven successful. The basis weight of the heat-sensitive recording layer is preferably between 2 g/m$^2$ and 6 g/m$^2$ or, better still, between 2.2 g/m$^2$ and 4.8 g/m$^2$.

In a particularly preferred embodiment, the heat-sensitive recording material according to the invention has a pigment-containing intermediate layer arranged between the barrier coating and the heat-sensitive recording layer.

The pigments of the intermediate layer can be organic hollow pigments as well as inorganic pigments, the latter preferably being selected from the group comprising both natural and calcined kaolin, silicon oxide and, in particular, bentonite, calcium carbonate and aluminum hydroxide, particularly boehmite. On one hand, an intermediate layer of this type can contribute in a positive manner to the leveling of the surface to be coated so that the required amount of coating composition to be applied for the heat-sensitive recording layer is reduced. For this reason, leveling coating devices such as, e.g., roller coating units, knife coating units, and (roll) doctor coating units are suitable for applying the pigmented intermediate layer. On the other hand, the pigments of this intermediate layer can absorb the wax constituents of the heat-sensitive recording layer which are liquefied by the heating action during formation of the print image and accordingly promote a more reliable and faster functioning of the heat-induced recording. The basis weight of the pigment-containing intermediate layer is preferably between 5 g/m$^2$ and 20 g/m$^2$ or, even better, between 7 g/m$^2$ and 11 g/m$^2$.

In the heat-sensitive recording material, according to the invention, which has at least a paper substrate and the barrier coating and heat-sensitive recording layer which are to be provided in this sequence on the front side of the substrate, the heat-sensitive recording layer is shielded toward the substrate by the barrier coating which presents a perfect and permanent protection against organic solvents.

When the tincture having the at least one organic solvent is applied to the back side of the substrate to form a mark as authenticating security feature early on in the production of the proposed heat-sensitive recording material and when the heat-sensitive recording material is produced and subsequently stored in roll form, it is noted that the front side and back side of the recording material come into contact in the roll. Due to the arrangement of a protective layer covering the heat-sensitive recording layer, the heat-sensitive recording layer can also be shielded outwardly and toward the substrate of the next layer of a roll by a protective layer of this kind. For this reason, the arrangement of a protective layer covering the heat-sensitive recording layer is preferred, this protective layer being formed in such a way that it provides good protection against organic solvents.

Besides a protective layer which, like the barrier coating, is produced on the basis of ethylene vinyl alcohol copolymer (EVOH) and which then preferably contains at least 90 percent by weight, particularly preferably at least 98 percent by weight, of the ethylene vinyl alcohol copolymer based in each instance on the total weight of a protective layer of this kind, it was also possible to achieve very good results with a protective layer having as binder at least 60 percent by weight, particularly preferably at least 85 percent by weight, of diacetone-modified polyvinyl alcohol based on the total binder component in the protective layer. A protective layer formed in this way is preferred within the meaning of the present invention.

In a first possible embodiment, the protective layer of the heat-sensitive recording material according to the invention can have, in addition to the diacetone-modified polyvinyl alcohol, additional binders, particularly mixtures of different carboxyl group-modified or silanol-modified polyvinyl alcohols. The latter then make up a maximum of 40 percent by weight, particularly preferably a maximum of only 15 percent by weight, based again on the total binder component in the protective layer. In a second possible embodiment, the protective layer of the heat-sensitive recording material according to the invention has exclusively diacetone-modified polyvinyl alcohol as binder. Particularly when diacetone-modified polyvinyl alcohol is the sole binder in the protective layer covering the heat-sensitive recording layer, it is particularly preferable when the proportion of binder in the protective layer is in a range from 35 to 65 percent by weight based on the total weight of the protective layer.

Suitable cross-linking agents in the protective layer are particularly those selected from the group comprising: boric acid, polyamine, epoxy resin, dialdehyde, formaldehyde oligomers, epichlorohydrin resin, adipic acid dihydrazide, dimethyl urea, and melamine formaldehyde. Mixtures of different cross-linking agents are also possible.

The ratio of weight percent of binder, particularly diacetone-modified polyvinyl alcohol, to cross-linking agent in the protective layer preferably ranges from 20:1 to 5:1, and is particularly preferably in the range of 12:1 to 7:1.

Particularly good results were achieved when the protective layer additionally contained an inorganic pigment. It is especially recommended that the inorganic pigment is selected from the group including silicon dioxide, aluminum hydroxide, bentonite, calcium carbonate, kaolin, or a mixture of these inorganic pigments. In particular, a ratio of pigment—and in this case, particularly preferably kaolin—to diacetone-modified polyvinyl alcohol is adjusted within a range of 1:1.5 to 1:4.5 based on the respective weight percentage of pigment and polyvinyl alcohol in the protective layer.

Roll doctor coating units, knife coating units, curtain coaters or air brushes are particularly suitable as coating apparatus for applying the protective layer covering the heat-sensitive recording layer. The basis weight of the protective layer is preferably between 1.0 g/m$^2$ and 3.0 g/m$^2$ or, better still, between 1.6 g/m$^2$ and 2.3 g/m$^2$.

Accordingly, pursuant to the preceding statements, it is particularly preferred that the heat-sensitive recording material proposed herein in all of its embodiments and alternative embodiments is used as a ticket, particularly preferably as an admission ticket. In this connection, it is conceivable that the heat-sensitive recording material according to the present application has additional security features such as, for example:

- fluorescent fibers and/or pigments in the substrate and/or at least one of the coatings including barrier coating, pigment-containing intermediate layer, heat-sensitive recording layer, and protective layer;
- substituted phthalides (for example: thymolphthalein or phenolphthalein), preferably in the protective layer, which temporarily exhibit a color-forming reaction when coming into contact with organic solvents, but without being in any way limited to the aforementioned security features.

The invention will be explained further with reference to the following examples 1 to 3:

For this purpose, a paper web of bleached, ground hardwood and softwood pulps with a basis weight of 130 g/m$^2$ and with the addition of common additives in conventional amounts is first produced on a Fourdrinier paper machine as substrate. Three sample rolls are cut out of the paper web for further processing.

For the three examples according to the invention, three different coating compositions are prepared for applying a barrier coating to the front of the respective substrate of the three sample rolls:

- Coating composition BS1 (for example 1) contains up to 99.5 percent by weight of ethylene vinyl alcohol copolymer (EVOH), more precisely Exceval HR 3010 (Kuraray), further constituents are primarily defoaming agents.
- Coating composition BS2 (for example 2) contains up to 99.5 percent by weight of common polyvinyl alcohol, more precisely Gohsenol NM 11 (Nippon Gohsei), further constituents are primarily defoaming agents.
- Coating composition BS3 (for example 3) contains up to 99.5 percent by weight of silanized polyvinyl alcohol, more precisely R 1130 (Kuraray), further constituents are primarily defoaming agents.

The coating compositions for examples 1 and 2 are diluted with water to a solids content of 12% for the intended application by means of air brush. The coating composition for example 3 is diluted with water to a solids content of 8.5%. The respective viscosities of the coating compositions are then determined on a Brookfield viscosimeter (spindle 3, 100 rpm, 23° C.) resulting in the following measured values:

coating composition BS1: 750,
coating composition BS2: 690,
coating composition BS3: 910.

For examples 1 to 3, the three coating compositions are now applied to the front side of the respective substrate of the three sample rolls with a respective basis weight of 2.8 g/m$^2$ (for examples 1 and 2) and 2.0 g/m$^2$ (for example 3).

For all three sample rolls, there are applied to the dried barrier coating within one pass through the multi-head coating machine being used:

- an intermediate layer of 8 g/m$^2$ having primarily calcined kaolin and organic hollow pigments as pigment mixture, styrene-butadiene latex as binder, and starch as co-binder by means of a roll doctor coater and subsequently
- a heat-sensitive recording layer having a basis weight of 4.2 g/m$^2$ by means of a roll doctor coating device.

The coating composition used for the heat-sensitive recording layer essentially contains the following components:

dye precursor: 3-dibutylamino-6-methyl-7-anilinofluoran, i.e., ODB-2;
color acceptor: N-(p-toluenesulphonyl)-N'-3-(p-toluenesulphonyl-oxyphenyl)urea, i.e., Pergafast® 201;
sensitizer: benzyl naphthyl ether, i.e., BNE;
binder: polyvinyl alcohol;
co-binder: acrylate copolymer;
pigment: calcium carbonate.

Finally, in all three sample rolls, a protective layer of 2.0 g/m$^2$ is applied to the heat-sensitive recording layer by means of air brush. A coating composition essentially containing the following components is used for this purpose:

- binder: diacetone-modified polyvinyl alcohol; 61.3 percent by weight (oven dry)
- cross-linking agent: adipic acid dihydrazide; 6.0 percent by weight (oven dry)
- pigment: kaolin; 16.6 percent by weight (oven dry)
- slipping agent: Hidorin Z-7-30; 8.1 percent by weight (oven dry)
- additives: pH control agents, optical brighteners; 8.0 percent by weight (oven dry).

A tincture with ethanol as chief constituent is subsequently applied to the back sides of the substrates of the three sample rolls by means of a stamp to form a mark as authenticating security feature. The effect of applying the tincture to the heat-sensitive recording layer is assessed visually.

The heat-sensitive recording layer of example 1 according to the invention shows no thermal reactions; the excellent quality of a barrier coating based on ethylene vinyl alcohol copolymer (EVOH) is confirmed. In example 2, slight thermal reactions are exhibited due to the paper substrate being wetted on the back side rather lightly with ethanol. However, this barrier coating is not suited to develop a sufficient protective action against organic solvents from the direction of the substrate as long as the amount and acting period of the solvent are deliberately kept very small. In example 3, as in example 1, no thermal reactions at all are exhibited on the heat-sensitive recording layer: in this case, the smaller amount of applied coating composition with the silanized polyvinyl alcohol is sufficient to develop an adequate protective effect against organic solvents from the direction of the substrate. In this case also, the amount and acting period of the solvent should not be too great.

This confirms the functionality of the proposed heat-sensitive recording material ultimately expected by the inventors.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A heat-sensitive recording material comprising;

a paper substrate;

a heat-sensitive recording layer arranged on the front side of said substrate and comprising at least one dye precursor and at least one color acceptor, wherein said dye precursor and said color acceptor react with one another under the action of heat to form color;

an authenticating security feature comprising a mark applied to the back side of said paper substrate and made of a tincture containing at least one organic solvent so as to cause change in opacity or transparency of said paper substrate; and a barrier coating arranged between said paper substrate and said heat-sensitive recording layer for protecting said heat-sensitive recording layer against penetration of said tincture into the heat-sensitive recording layer from the back side.

2. The heat-sensitive recording material according to claim 1, wherein said authenticating security feature is applied individually for every individual paper substrate.

3. The heat-sensitive recording material according to claim 2, wherein said tincture is applied by an inkjet printing method.

4. The heat-sensitive recording material according to claim 1, wherein said barrier coating comprises as a binder at least 60 percent by weight of diacetone-modified polyvinyl alcohol based on the total weight of said barrier coating.

5. The heat-sensitive recording material according to claim 4, wherein said barrier coating comprises a cross-linking agent selected from the group comprising: boric acid, polyamine, epoxy resin, dialdehyde, formaldehyde oligomers, epichlorohydrin resin, adipic acid dihydrazide, dimethyl urea, and melamine formaldehyde.

6. The heat-sensitive recording material according to claim 4, wherein said recording material further comprises a protective layer.

7. The heat-sensitive recording material according to claim 6, wherein the ratio of weight percent of diacetone-modified polyvinyl alcohol to cross-linking agent is in a range of 20:1 to 5:1.

8. The heat-sensitive recording material according to claim 4, wherein the ratio of weight percent of diacetone-modified polyvinyl alcohol to cross-linking agent is in a range of 12:1 to 7:1.

9. The heat-sensitive recording material according to claim 1, wherein said barrier coating comprises at least 90 percent by weight of ethylene vinyl alcohol copolymer (EVOH) based on the total weight of said barrier coating.

10. The heat-sensitive recording material according to claim 1, wherein said barrier coating contains at least 98 percent by weight of ethylene vinyl alcohol copolymer (EVOH) based on the total weight of said barrier coating.

11. The heat-sensitive recording material according to claim 1, wherein said heat-sensitive recording layer contains as color receptor at least one substance selected from the group comprising:

2,2-bis(4-hydroxyphenyl)propan,

4-[(4-(1-methylethoxy)phenyl)sulfonyl]phenol, 4,4'-dihydroxydiphenyl sulfone,

N-(p-toluenesulphonyl)-N'-3-(p-toluenesulphonyloxyphenyl)urea, 2,4'-dihydroxydiphenyl sulfone, N-(2-hydroxyphenyl)-2-[(4-hydroxyphenyl)thio]acetamide.

12. The heat-sensitive recording material according to claim 11, characterized in that 4,4'-dihydroxydiphenyl sulfone is the sole color acceptor in said heat-sensitive recording layer.

13. The heat-sensitive recording material according to claim 12, wherein a ratio of 4,4'-dihydroxydiphenyl sulfone to a sensitizer selected from the group comprising methylolstearamide, stearic acid amide, and dimethyl terephtalate based on weight percent in said recording layer is in the range of 1:0.5 to 1:2.

14. The heat-sensitive recording material according to claim 11, characterized in that N-(p-toluenesulphonyl)-N'-3-(p-toluenesulphonyloxyphenyl)urea is the sole color acceptor in the heat-sensitive recording layer.

15. The heat-sensitive recording material according to claim 1, wherein said heat-sensitive recording layer comprises as dye precursor at least one substance selected from the group comprising: 3-diethylamino-6-methyl-7-anilinofluoran, 3-dibutylamino-6-methyl-7-anilinofluoran, 3-(N-methyl-N-propyl)amino-6-methyl-7-anilinofluoran, 3-(N-ethyl-N-isoamyl)amino-6-methyl-7-anilinofluoran, 3-(N-methyl-N-cyclohexyl)amino-6-methyl-7-anilinofluoran, 3-(N-ethyl-N-tolyl)amino-6-methyl-7-anilinofluoran, and 3-(N-ethyl-N-tetrahydrofuryl)amino-6-methyl-7-anilinofluoran.

16. The heat-sensitive recording material according to claim 1, wherein said heat-sensitive recording layer comprises as binder a substance selected from the group comprising: polyvinyl alcohol, ethylene vinyl alcohol copolymer, or a combination of polyvinyl alcohol and ethylene vinyl alcohol copolymer.

17. The heat-sensitive recording material according to claim 1, wherein said recording material further comprises a pigment-containing intermediate layer arranged between said barrier coating and said heat-sensitive recording layer.

18. The heat-sensitive recording material according to claim 1, wherein said recording material further comprises a protective layer.

19. The heat-sensitive recording material according to claim 18, wherein said protective layer comprises as binder at least 60 percent by weight of diacetone-modified polyvinyl alcohol based on the total binder component in said protective layer.

20. The heat-sensitive recording material according to claim 18, wherein said protective layer comprises a cross-linking agent selected from the group comprising: boric acid, polyamine, epoxy resin, dialdehyde, formaldehyde oligomers, epichlorohydrin resin, adipic acid dihydrazide, dimethyl urea, and melamine formaldehyde.

* * * * *